US011141853B1

(12) United States Patent
Murray

(10) Patent No.: US 11,141,853 B1
(45) **Date of Patent: *Oct. 12, 2021**

(54) MULTIPART COVER AND A HANDLE FORMED THEREWITH

(71) Applicant: Michael P. Murray, Phoenix, AZ (US)

(72) Inventor: Michael P. Murray, Phoenix, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/876,069

(22) Filed: May 17, 2020

Related U.S. Application Data

(63) Continuation of application No. 16/175,606, filed on Oct. 30, 2018, now Pat. No. 10,654,164.

(51) Int. Cl.

| | |
|---|---|
| ***B25G 1/10*** | (2006.01) |
| *B66F 5/02* | (2006.01) |
| *B66F 13/00* | (2006.01) |

(52) U.S. Cl.
CPC ..... *B25G 1/102* (2013.01); *B66F 5/02* (2013.01); *B66F 13/00* (2013.01)

(58) Field of Classification Search
CPC . Y10T 16/4576; Y10T 16/469; Y10T 16/466; Y10T 16/4724; A45F 5/00; A45F 5/102; A45F 5/1026; A45F 5/1046; A45F 5/10; A45F 2005/1053; A45F 2005/1033; A47F 13/085; B65G 7/12; B65G 7/01; B65G 7/10; B25G 1/102
See application file for complete search history.

(56) References Cited

U.S. PATENT DOCUMENTS

| | | | | |
|---|---|---|---|---|
| 2,984,486 | A | 5/1961 | Jones | |
| 3,884,495 | A | 5/1975 | Petock | |
| 3,981,043 | A | 9/1976 | Curry | |
| 4,262,385 | A | 4/1981 | Norman | |
| 4,805,937 | A | 2/1989 | Boucher et al. | |
| 5,299,802 | A | 4/1994 | Bouchet-Lassale | |
| 5,469,601 | A | 11/1995 | Jackson | |
| 5,492,425 | A | 2/1996 | Carter et al. | |
| 5,511,445 | A | 4/1996 | Hildebrandt | |
| 5,700,053 | A | 12/1997 | Downing | |
| 5,722,672 | A | 3/1998 | Frederick | |
| 5,775,756 | A | 7/1998 | Rozenich | |
| 5,890,260 | A | 4/1999 | Gaunt | |
| 6,006,403 | A | 12/1999 | Battiato | |
| 6,036,607 | A | 3/2000 | Finegan | |
| 6,234,924 | B1 | 5/2001 | Washburn, Jr. | |
| 6,604,789 | B1 | 8/2003 | Downing | |
| 6,647,589 | B1 | 11/2003 | Youngwith | |
| 6,796,002 | B2 * | 9/2004 | Beckwith | A45C 13/26 16/110.1 |
| 6,817,066 | B1 | 11/2004 | Williams et al. | |

(Continued)

*Primary Examiner* — Chuck Y Mah
(74) *Attorney, Agent, or Firm* — Parsons & Goltry, PLLC; Michael W. Goltry; Robert A. Parsons

(57) ABSTRACT

A handle assembly including an elongate handle having an inner end, an outer end, and a length between the inner end and the outer end, and a multipart cover including an inner cover, and an outer cover. The inner cover is fitted removably over the length of the handle, the outer cover is fitted removably over the inner cover, the inner cover and the outer cover concurrently encircle and extend along the length of the handle from proximate to the inner end of the handle to proximate to the outer end of the handle, and the outer cover includes a chemically-resistant exterior gripping surface.

13 Claims, 10 Drawing Sheets

(56) References Cited

U.S. PATENT DOCUMENTS

| | | | | |
|---|---|---|---|---|
| 6,854,163 | B1 | 2/2005 | Ruana | |
| 6,872,157 | B2 | 3/2005 | Falone et al. | |
| 7,220,195 | B1 | 5/2007 | Cronin | |
| 7,232,352 | B2 | 6/2007 | Splaine | |
| 7,673,770 | B2 | 3/2010 | Summerfield | |
| 8,128,541 | B2 * | 3/2012 | Hartman | A63B 23/16 482/139 |
| 8,151,404 | B1 | 4/2012 | Gundlach | |
| 8,695,168 | B1 | 4/2014 | Cepeda | |
| 9,003,592 | B2 | 4/2015 | Smith | |
| 9,095,971 | B1 | 8/2015 | Douglas | |
| 2002/0072455 | A1 | 6/2002 | Akins | |
| 2003/0213115 | A1 | 11/2003 | Knapton | |
| 2004/0048529 | A1 | 3/2004 | Splaine | |
| 2004/0050205 | A1 | 3/2004 | Putnam | |
| 2006/0064851 | A1 | 3/2006 | Kincaid | |
| 2008/0289148 | A1 | 11/2008 | Summerfield | |
| 2009/0312125 | A1 | 12/2009 | Kearns | |
| 2011/0232038 | A1 | 9/2011 | Miller | |
| 2012/0240307 | A1 | 9/2012 | Terrell et al. | |

* cited by examiner

MULTIPART COVER AND A HANDLE FORMED THEREWITH

FIELD OF THE INVENTION

The present invention relates to a multipart cover for handles of handle-operated machines used in workshops, garages, and similar environments where inherently corrosive and slippery chemical substances, such as lubricants and fuels, are used.

BACKGROUND OF THE INVENTION

A workshop is a room, rooms, a garage, or building which provides the area, tools, and machines required for the manufacture or repair of machines, goods, vehicles, and the like. Workshops may vary in industrial focus. For instance, some workshops focus on automotive repair or restoration, while others can focus on woodworking, metalworking, electronics work, or electronic or equipment prototyping.

A typical workshop contains a workbench, machines, such as hand tools and power tools, and other hardware useful for manufacturing, repair, and maintenance. Many of the machines used in a typical workshop are operated by a handle, which is gripped by hand and actuated manually to operate the machine. For example, the handles of some machines are actuated by rotation, whereas others are actuated by cranking the handle back-and-forth, as is the case with mechanical floor jacks useful for lifting and lower heavy loads and applying great forces.

A typical workshop also includes chemical substances, such as lubricants, greases, motor oils, fuels, solvents, and the like for use, as a matter of example, in cleaning, maintaining, repairing, and operating machines, equipment, motors, and vehicles. Often, the hands of a skilled workman working in a well-equipped workshop become exposed to and coated with one or more of the above-described chemical substances, which can make gripping a handle difficult because of the hands being slippery on the handle, and which can cause the workman's hands to inadvertently slip along the handle when actuating the handle-operated machine which can inherently interfere with the ability of the workman to efficiently and safely operate the handle-operated machine and which can result in unwanted injury. Since many of the lubricants, greases, oils, fuels, solvents and other like or similar chemical substances commonly found in the well-furnished workshop are inherently corrosive, transfer of these chemical substances to machine handles from the workman's hands can cause unwanted corrosion and resulting damage to the handles.

For the purpose of solving these and other problems inherent in the prior art, there is a need in the art for a cover assembly for a handle of a handle-operated machine that is easy to install and remove, that is chemically resistant for isolating the handle from lubricants, greases, motor oils, fuels, solvents, and other chemical substances, and that provides a chemically-resistant gripping surface for safely and efficiently gripping and actuating the handle by hand for operating the handle-operated machine and that is resistant to slipping even when chemical substances are on the workman's hands.

SUMMARY OF THE INVENTION

According to the principle of the invention, a handle assembly includes an elongate handle including an inner end, an outer end, and a length between the inner end and the outer end, and a multipart cover including an inner cover, and an outer cover. The inner cover is fitted removably over the length of the handle, the outer cover is fitted removably over the inner cover, the inner cover and the outer cover concurrently encircle and extend along the length of the handle from proximate to the inner end of the handle to proximate to the outer end of the handle, and the outer cover includes a chemically-resistant exterior gripping surface. The inner cover includes a first end proximate to the inner end of the handle, a second end proximate to the outer end of the handle, a length from the first end of the inner cover to the second end of the inner cover, and an end gap that severs the inner cover from the first end of the inner cover to the second end of the inner cover defining a first marginal extremity of the inner cover and a second marginal extremity of the inner cover concurrently extending from the first end of the inner cover to the second end of the inner cover. The inner cover is fabricated of a compressible material, which is foam in an illustrative embodiment. The outer cover includes a first end proximate to the first end of the inner cover, a second end proximate to the second end of the inner cover, a length from the first end of the outer cover to the second end of the outer cover, an inner surface against the inner cover, and an outer surface formed with a chemically-resistant material defining the chemically-resistant exterior gripping surface of the outer cover. The inner end of the handle extends beyond the first end of the inner cover and the first end of the outer cover, and the outer end of the handle extends beyond the second end of the inner cover and the second end of the outer cover. The outer cover is fabricated principally of a compressible material, which is neoprene in an illustrative embodiment. The chemically-resistant material is a chemically-resistant elastomer. The outer cover further includes a first marginal extremity and a second marginal extremity concurrently extending from the first end of the outer cover to the second end of the outer cover. The outer cover is wrapped about the inner cover juxtaposing the first marginal extremity of the outer cover relative to the second marginal extremity of the outer cover. A fastener releasably secures the first marginal extremity of the outer cover to the second marginal extremity of the outer cover. The chemically-resistant material extends from the first end of the outer cover to the second end of the outer cover and from the first marginal extremity of the outer cover to the second marginal extremity of the outer cover. The fastener includes a hook-and-loop fastener including an element thereof carried by the first marginal extremity of the outer cover and a complemental element thereof carried by the second marginal extremity of the outer cover. In another embodiment, the fastener is a slide fastener.

According to the principle of the invention, a handle-operated machine including a handle having an inner end, an outer end, and a length between the inner end and the outer end, the handle-operated machine operable for performing a task in response to manual actuation of the handle by hand. A multipart cover includes an inner cover, and an outer cover. The inner cover is fitted removably over the length of the handle, the outer cover is fitted removably over the inner cover, the inner cover and the outer cover concurrently encircle and extend along the length of the handle from proximate to the inner end of the handle to proximate to the outer end of the handle, and the outer cover includes a chemically-resistant exterior gripping surface. The inner cover includes a first end proximate to the inner end of the handle, a second end proximate to the outer end of the handle, a length from the first end of the inner cover to the second end of the inner cover, and an end gap that severs the inner cover from the first end of the inner cover to the second end of the inner cover defining a first marginal extremity of the inner cover and a second marginal extremity of the inner cover concurrently extending from the first end of the inner cover to the second end of the inner cover. The inner cover is fabricated of a compressible material, which is foam in an illustrative embodiment. The outer cover includes a first end proximate to the first end of the inner cover, a second end proximate to the second end of the inner cover, a length from the first end of the outer cover to the second end of the outer cover, an inner surface against the inner cover, and an outer surface formed with a chemically-resistant material defining the chemically-resistant exterior gripping surface of the outer cover. The inner end of the handle extends beyond the first end of the inner cover and the first end of the outer cover, and the outer end of the handle extends beyond the second end of the inner cover and the second end of the outer cover. The outer cover is fabricated principally of a compressible material, which is neoprene in an illustrative embodiment. The chemically-resistant material is a chemically-resistant elastomer. The outer cover further includes a first marginal extremity and a second marginal extremity concurrently extending from the first end of the outer cover to the second end of the outer cover. The outer cover is wrapped about the inner cover juxtaposing the first marginal extremity of the outer cover relative to the second marginal extremity of the outer cover. A fastener releasably secures the first marginal extremity of the outer cover to the second marginal extremity of the outer cover. The chemically-resistant material extends from the first end of the outer cover to the second end of the outer cover and from the first marginal extremity of the outer cover to the second marginal extremity of the outer cover. The fastener includes a hook-and-loop fastener including an element thereof carried by the first marginal extremity of the outer cover and a complemental element thereof carried by the second marginal extremity of the outer cover. In another embodiment, the fastener is a slide fastener.

BRIEF DESCRIPTION OF THE DRAWINGS

Referring to the drawings.

DETAILED DESCRIPTION

A multipart cover, a handle formed with a multipart cover, and methods of installing a multipart cover on a handle are disclosed.

Figure 1:
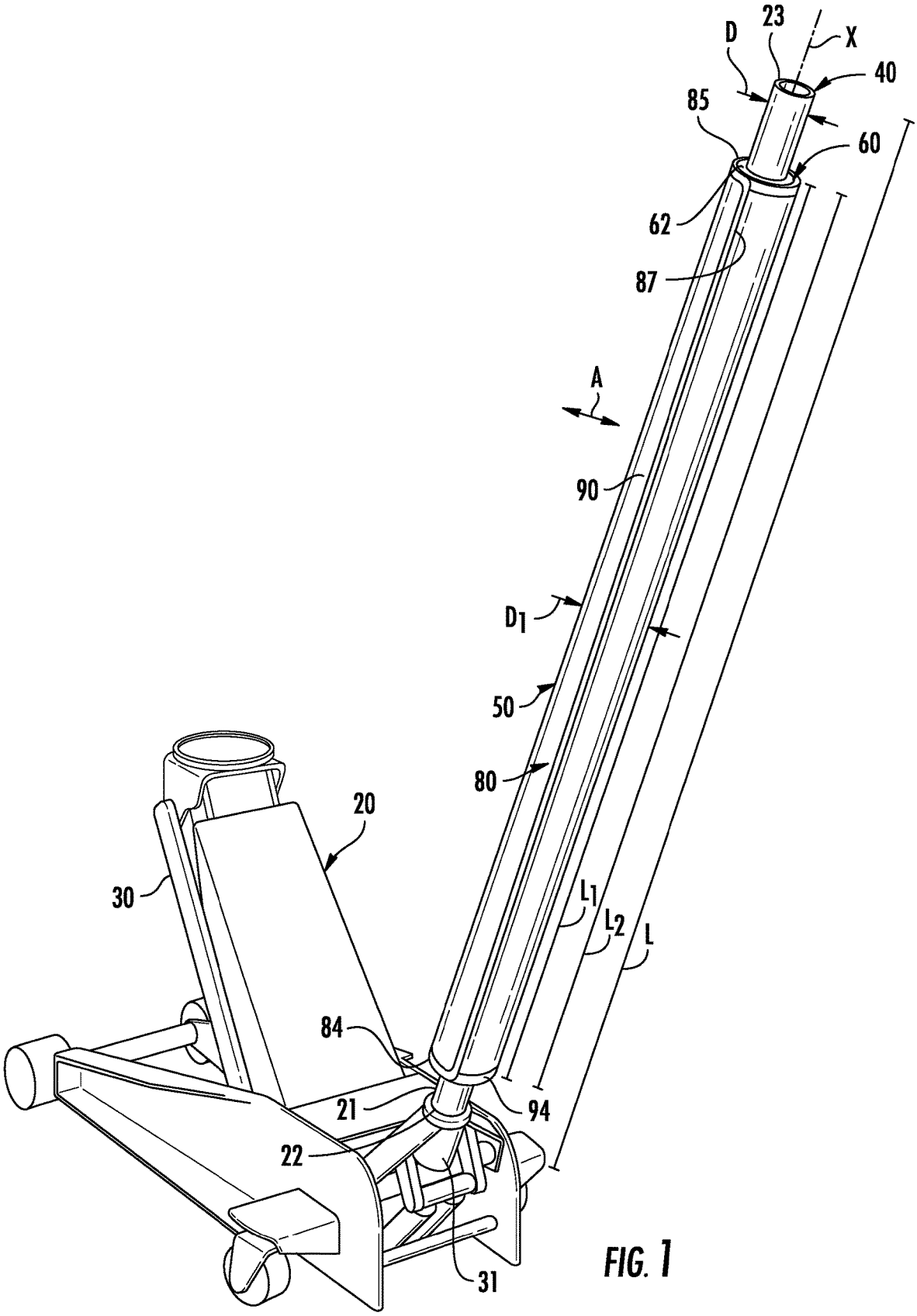
FIG. 1 is a perspective view of a handle-operated machine including a handle having an inner end, an outer end, and a length between the inner end and the outer end, the handle-operated machine operable for performing a task in response to manual actuation of the handle by hand, and additionally including a multipart cover including an inner cover fitted removably over the length of the handle, and an outer cover fitted removably over the inner cover, wherein the multipart cover and the handle form a handle assembly, the inner cover and the outer cover concurrently encircle or girdle, and extend along, the length of the handle from proximate to the inner end of the handle to proximate to the outer end of the handle, and the outer cover includes a chemically-resistant exterior gripping surface.
Figure 2:
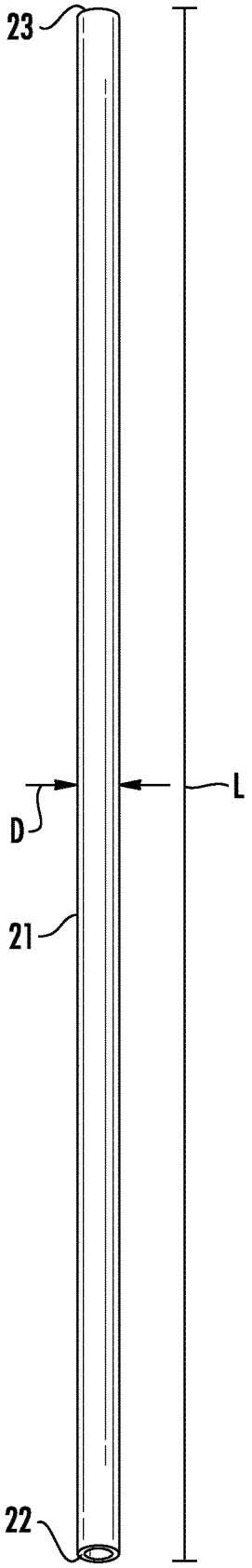
FIG. 2 is a perspective view of the handle of the handle assembly of FIG. 1.

Turning now to the drawings, in which like reference characters indicate corresponding elements throughout the several views, attention is directed to FIG. 1 illustrating handle-operated machine 20 including, with additional reference to FIG. 2, handle 21 having inner end 22, outer end 23, outer surface 24 defining outer diameter D along length L of handle 21 between inner end 22 and outer end 23. Handle 21 is cylindrical, and outer surface 24 is a cylindrical outer surface. Handle 21 is fashioned of metal in this embodiment, such as steel or aluminum, and is strong and rigid. Central axis X extends centrally through handle 21 from inner end 22 to outer end 23 about which handle 21 is arranged and is symmetrical. Inner end 22 of handle 21 is operatively connected to machine 20, which is operable for performing a task in response to manual actuation of handle 21 by hand. Additionally included is multipart cover 50 including inner cover 60 and outer cover 80. Inner cover 60 is fitted removably over length L of handle 21. Outer cover 80 is fitted removably over inner cover 60. Multipart cover 50 and handle 21 form handle assembly 40. Inner cover 60 and outer cover 80 concurrently encircle or girdle, and extend along, diameter D of length L of handle 21 from proximate to inner end 22 of handle 21 to proximate to outer end 23 of handle 21.

Machine 20 is operable for performing a task in response to manual actuation of handle 21 by hand. Machine 20 is a conventional and well-known floor jack 30 operated by handle 21. In FIG. 1, inner end 22 of handle 21 is conventionally secured to the known receiver 31 of jack 30 operatively coupling handle 21 to jack 30, which is operable for lifting and lowering heavy loads and applying great forces in response to cranking handle 21 back-and-forth by hand in the directions indicated by double arrowed line A. Jack 30 is an example of a handle-operated machine, a machine operated by a manual actuation of handle 21, operable for performing a task, the lifting and lowering of heavy loads and applying of great forces in this example, in response to manual actuation of handle 21 by hand, the manual cranking of handle 21 by hand back-and-forth in the direction of double arrowed line A in this example.

Jack 30 is generally representative of a conventional floor jack that is well known and commonly used in workshops and garages for lifting and lowering heavy loads, such vehicles, vehicle parts, and the like relative to the floor upon which jack 30 is positioned. Accordingly, further details of jack 30 are known to the skilled artisan and are not discussed. Since skilled workers in workshops and garages where floor jacks are found, including jack 30, use chemical substances, such as lubricants, greases, motor oils, fuels, solvents, and the like for use, as a matter of example, in cleaning, maintaining, repairing, and operating machines, equipment, motors, vehicles, etc., transfer of these and other like or similar chemical substances from the workman's hands to outer surface 24 of handle 21 is inevitable, which can make outer surface 24 slippery and difficult to grip by hand for safely and efficiently operating jack 30 via handle 21, and which can result in unwanted corrosion to outer surface 24 of handle 21. According to the principle of the invention, multipart cover 50 and application of multipart cover 50 to handle 21 solves at least these problems.

According to the principle of the invention, in FIG. 1 handle 21 is furnished with multipart cover 50 forming handle assembly 40. Multipart cover 50 is easy to install and remove, and provides a secure gripping surface for the skilled worker to safely and efficiently grip by hand for actuating handle 21 to operate the handle-operated machine, which, in this instance, is jack 30, and that is chemically-resistant, being resistant and impervious to lubricants, greases, motor oils, fuels, solvents, and other chemical substances, for isolating handle 21 from these and like or similar chemical substances commonly found in workshops and garages.

Figure 3:
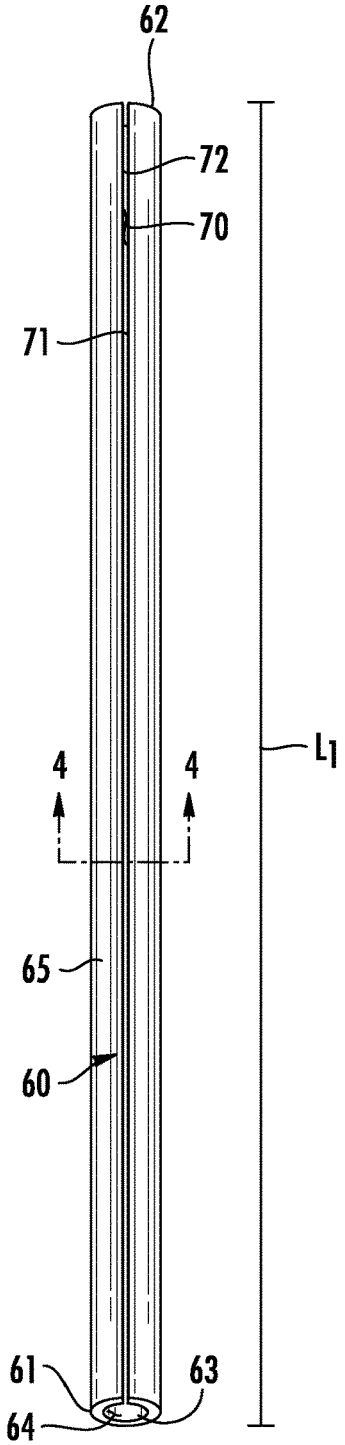
FIG. 3 is as perspective view of the inner cover of the handle assembly of FIG. 1.
Figure 4:
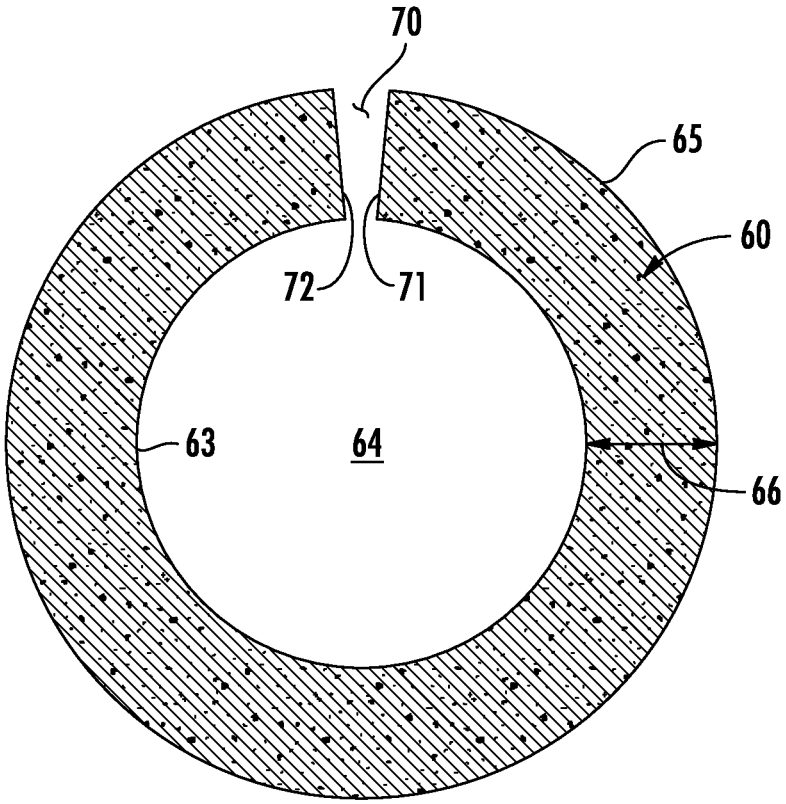
FIG. 4 is a section view across line 4-4 of FIG. 3.

Referring in relevant part to FIGS. 3 and 4, inner cover 60 is an elongate, severed annular body/sleeve including first end 61, second end 62, length L1 from first end 61 to second end 62, inner surface 63 defining volume 64 from first end 61 to second end 62, outer surface 65, and an axial dimension or thickness 66 that extends from inner surface 63 to outer surface 65. First and second end 61 and 62 are each open to volume 64. End gap 70 to volume 64 severs inner cover 60 from first end 61 to second end 62 defining first marginal extremity 71 of inner cover 60 and opposed second marginal extremity 72 of inner cover 60. First marginal extremity 71 and second marginal extremity 72 are parallel relative to each other and concurrently extend from first end 61 of inner cover 60 to second end 62 of inner cover 60. Inner cover 60 is a pad, being padding, fabricated of a flexible, cushiony, and compressible padding material. Inner cover 60 is preferably formed of a foam padding material having inherently strong, resilient, cushiony, compressible, flexible, and shape memory material characteristics. Preferably, inner cover 60 is formed of a strong, resilient, tear-resistant, flexible, closed-cell foam, such as polyethylene foam, polyurethane foam, polystyrene foam, or other like or similar material having the above-described inherent material characteristics being ideally suited as a shock-absorbing material.

Figure 5:
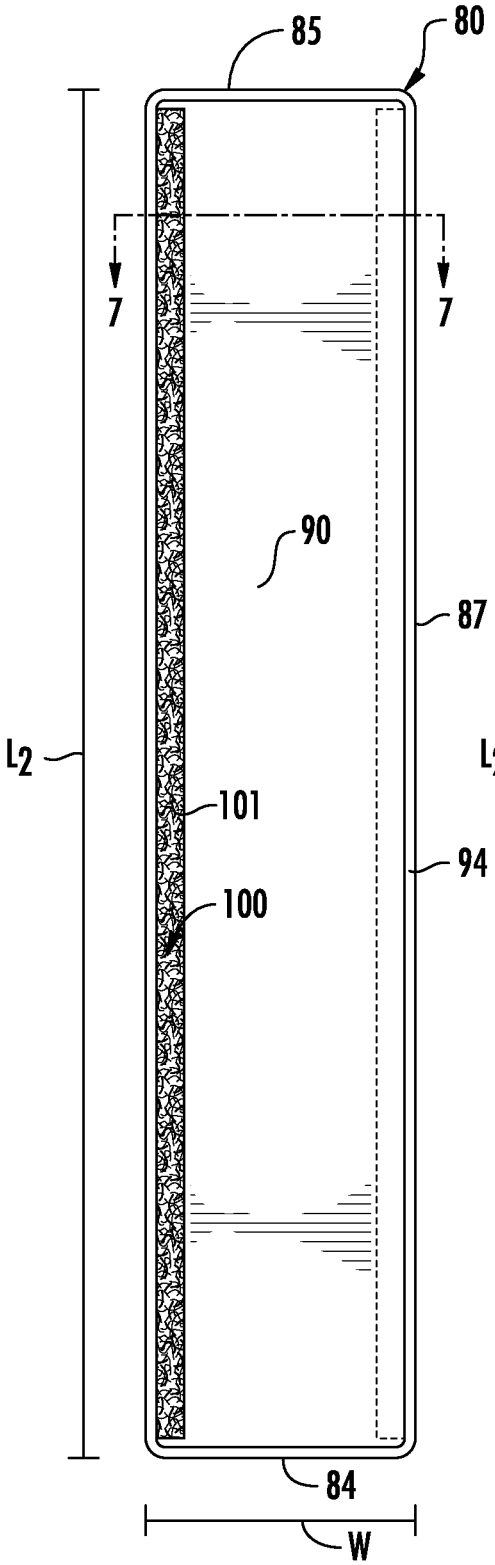
FIG. 5 is a top plan view of the outer cover of the handle assembly of FIG. 1.
Figure 6:
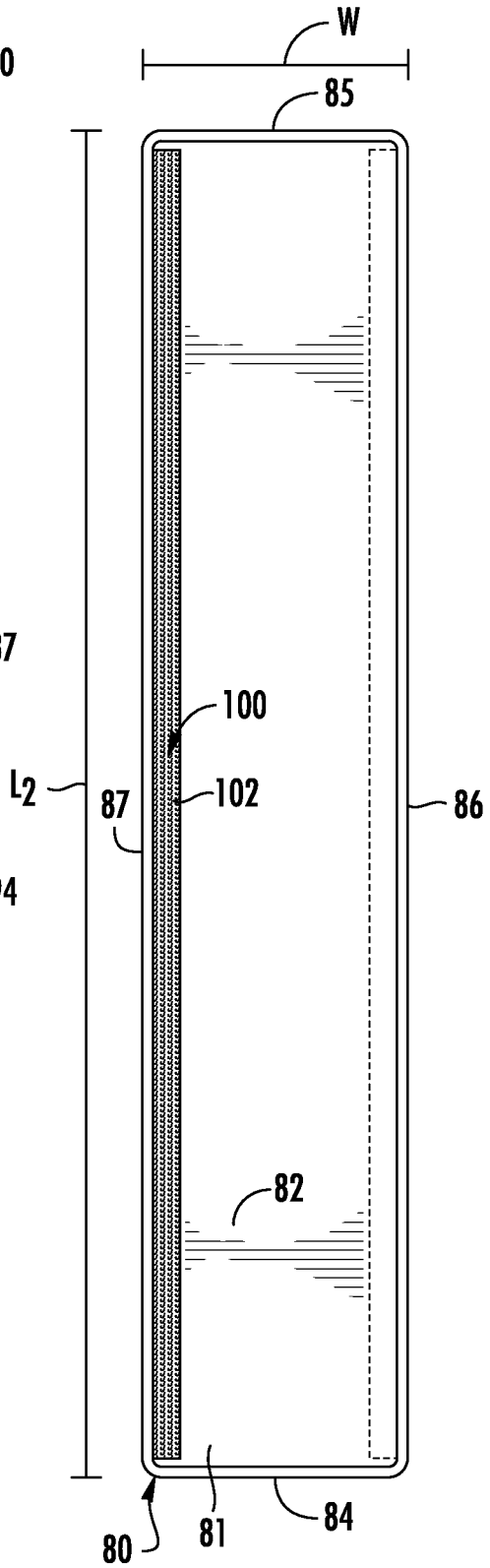
FIG. 6 is a bottom plan view of the embodiment of FIG. 5.
Figure 7:
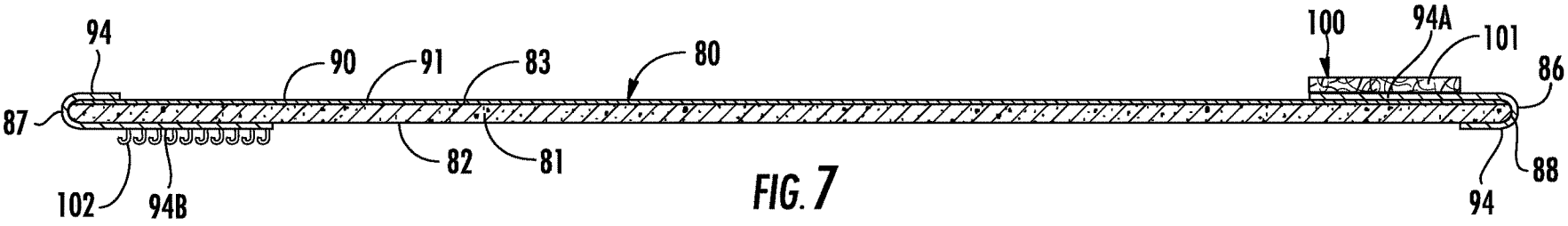
FIG. 7 is a section view taken along line 7-7 of FIG. 5.

Referring to FIGS. 5-7 in relevant part, outer cover includes first end 84, second end 85, first marginal extremity 86, second marginal extremity 87, length L2 from first end 84 to second end 85, width W from first marginal extremity 86 to second marginal extremity 87, inner surface 82, and chemically-resistant exterior gripping surface 90. First and second ends 84 and 85 are equal in length and are parallel to each other, first and second marginal extremities 86 and 87 are equal in length and are parallel to each other and are perpendicular to first and second ends 84 and 85, first and second ends 84 and 85 each extend from first marginal extremity 86 to second marginal extremity 87, and first and second marginal extremities 86 and 87 each extend from first end 84 to second end 85. Outer cover 80 is elongate, and first and second marginal extremities 86 and 87 are longer than first and second ends 84 and 85, in which length L2 is greater than width W, and is equal to length L1 of inner cover 60, in which outer cover 80 is elongate from first and to second end 84 and 85 and is rectangular in overall shape.

With continuing reference to FIGS. 5-7 in relevant part, outer cover 80 includes three main parts, namely, substrate 81, chemically-resistant material layer or coating 91 that defines chemically-resistant exterior gripping surface 90, and border 94. Substrate 81 is a pad, being padding, fabricated of a flexible, cushiony, and compressible padding material. Substrate 81 is preferably formed of a synthetic rubber material having inherently strong, tear-resistant, resilient, cushiony, compressible, flexible, and shape memory material characteristics, and that is inherently exhibits chemical stability and flexibility over a wide temperature range. A preferred material for substrate 81 is neoprene, a synthetic rubber produced by polymerization of chloroprene. Other like or similar materials having the same or similar inherent material characteristics can be used for substrate 81.

Substrate 81 includes inner surface 82, outer surface 83, and peripheral edge 88 over which there is an applied border 94. Border 94 is continuous, covers entire peripheral edge 88 for protection purposes, and, in this example, is fashioned a fabric, such as polyester fabric, a polyester-spandex fabric blend, or other chosen fabric having the inherently properties of resilience, flexibility, elasticity, and ruggedness. Border is 94 is affixed to substrate 81 by stitching, heat bonding, adhesive, or the like, being rigidly affixed to substrate 81 while at the same time concurrently extending over and forming a part of first end 84, second end 85, first marginal extremity 86, and second marginal extremity 87. Peripheral edge 88 and border 94 over peripheral edge cooperate to define first end 84, second end 85, first marginal extremity 86, and second marginal extremity 87 of outer cover 80. Substrate 81 forms the majority of outer cover 80. Since substrate 81 forms the majority of, or otherwise most of, outer cover 80, outer cover 80 is fabricated principally of a material, the material of substrate 81, having inherently strong, trear-resistant, resilient, cushiony, compressible, flexible, and shape memory material characteristics, and that inherently exhibits chemical stability and flexibility over a wide temperature range.

Chemically-resistant exterior gripping surface 90 is part of layer or coating 91 of a chemically-resistant material applied to the entirety of outer surface 83 of substrate 81 from first end 84 to second end 85 and from first marginal extremity 86 to second marginal extremity 87. The chemically-resistant material of layer or coating 91 that defines chemically-resistant exterior gripping surface 90 is preferably a chemically-resistant elastomer, such as a silicone elastomer, a polyvinyl chloride elastomer, a polyurethane elastomer, or other like or similar elastomer having inherently flexible, durable, and chemical-resistant material characteristics, being resistant and impervious to lubricants, greases, motor oils, fuels, solvents, and other chemical substances discussed herein that are commonly found in workshops and garages. Coating 91 is applied, such as by being sprayed, rolled, or spread, onto the entirety of outer surface 83 of substrate 81, and subsequently cured.

Outer cover 80 incorporates fastener 100 for releasably securing/connecting first marginal extremity 86 to second marginal extremity 87. In this example, fastener 100, a fastener assembly, is a conventional and well-known hook-and-loop fastener, such as a type commonly found under the trademark VELCRO®, including element 101 thereof carried by first marginal extremity 86 and complemental element thereof 92 carried by second marginal extremity 87. Element 101 in FIG. 5 extends along inner surface 81 of substrate 81 adjacent and parallel to first marginal extremity 86 from proximate to first end 84 to proximate to second end 85, and complemental element 102 in FIG. 6 extends along inner gripping surface 90 adjacent and parallel to second marginal extremity 87 from proximate to first end 84 to proximate to second end 85. Element 101 and complemental element 102 are equal in length. In FIG. 7, element 101 extends over extension 94A of border 94 extending over inner surface 82 of substrate 81 from first marginal extremity 86 and between first and second ends 84 and 85, all of which are sewn together thereby securing element 101 in place. Complemental element 102 extends over extension 94B of border 94 extending over gripping surface 90 from second marginal extremity 87 and between first and second ends 84 and 85, all of which are sewn together thereby securing complemental element 102 in place. In this example of fastener 100, element 101 is a loop medium of the hook-and-loop fastener, and complemental element 102 is the hook medium of the hook-and-loop fastener, and this arrangement can be reversed if desired.

When multicover 50 is installed onto handle 21, inner cover 60 encircles or girdles diameter D of length L of handle 21 between inner and outer ends 23 of handle 21, from first marginal extremity 71 of inner cover 60 to second marginal extremity 72 of inner cover 60 extending from first end 61 of inner cover 60 to second end 62 of inner cover 60, and outer cover 80 encircles or girdles inner cover 60. To install multicover 50 onto handle 21 in accordance with an exemplary method of installing multipart cover 50 on a handle, inner cover 60 is wrapped around outer surface 24 of handle 21 along length L of handle 21 between inner end 22 and outer end 23 of handle 21, and outer cover 80 is wrapped around inner cover 60, the details of which are discussed below according to the exemplary method.

Figure 8:
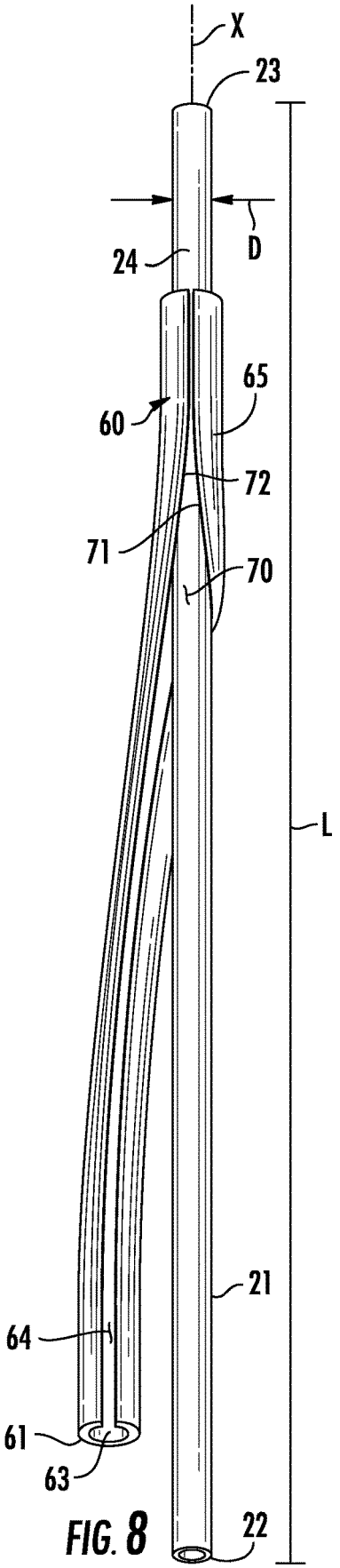
FIGS. 8 and 9 illustrate a sequence of steps of installing the inner cover of FIG. 3 on the handle of FIG. 2.
Figure 9:
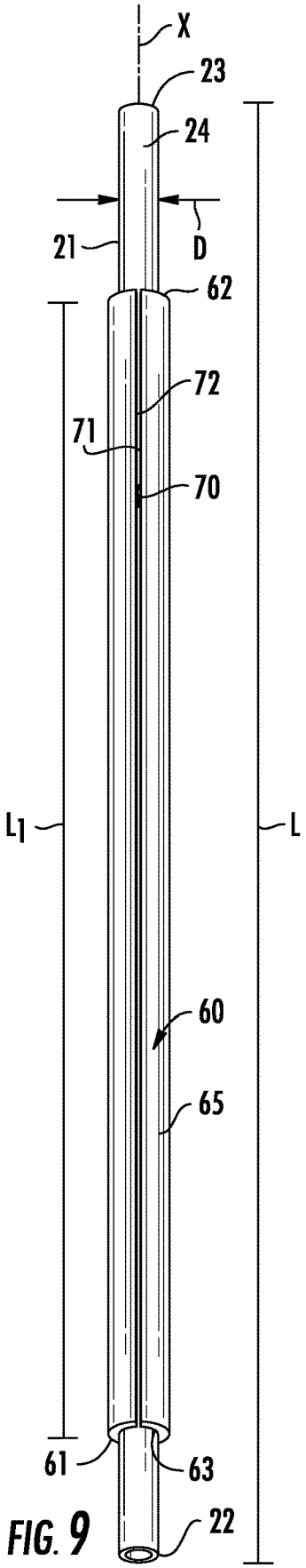

To install inner cover 60 over length L of handle 21 between inner end 22 and outer end 23 of handle 21 according to the installation method, first and second marginal extremities 71 and 72 are spread apart by hand to widen end gap 70, while at same time length L of handle 21 between inner end 22 and outer end 23 is applied through the widened end gap 70 between first and second marginal extremities 71 and 72 and into volume 64. FIG. 8 shows inner cover 60 as it would appear partially installed over length L of handle 21 between inner end 22 and outer end 23, with a portion of length of handle 21 near outer end 23 positioned in volume 64 through end gap 70 between first and second marginal extremities 71 and 72 and an intermediate portion of length L of handle 21 as it would appear extending inwardly into volume 64 through widened end gap 70 between first and second marginal extremities 71 and 72 during installation. FIG. 9 shows inner cover 60 as it would appear fully installed over length L of handle 21 between inner end 22 and outer end 23. Referring in relevant part to FIGS. 9 and 13, length L of handle 21 between inner end 22 and outer end 23 extends through volume 64 from first end 61 of inner cover 60 to second end 62 of inner cover 60, inner end 22 of handle 21 extends through and beyond first end 61 of inner cover 60, outer end 23 extends through and beyond second end 62 of inner cover 60, and the inherent flexible and shape memory material characteristics of inner cover 60 causes inner cover 60 to circumferentially constrict inner surface 63 of inner cover 60 from first marginal extremity 71 to second marginal extremity 72 of inner cover 60 and from first end 61 to second end 62 of inner cover 60 directly against outer surface 24 of length L of handle 21 between inner end 22 and outer end 23 of handle 21, when length L of handle 21 between inner and outer ends 22 and 23 of handle 21 is installed in volume 64 through end gap 70, in which inner cover 60 circumscribes, encircles, girdles, or otherwise extends around diameter D and outer surface 24 of length L of handle 21 from first marginal extremity 71 to second marginal extremity 72 and from inner end 61 to outer end 62 of inner cover 60, inner surface 63 of inner cover 60 directly frictionally contacts, and thereby inherently grips, outer surface 24 of length of handle L from first end 61 of inner cover 60 to second end 62 of inner cover and from first marginal extremity 71 of inner cover 60 to second marginal extremity 72 of inner cover 60, thickness 66 of inner cover 60 extends outwardly from inner surface 64 to outer surface 65 which extends from first end 61 to second end 62 and from first marginal extremity 71 to second marginal extremity 72, length L1 of inner cover 60 extends along length L of handle 21 between inner and outer ends 22 and 23 of handle 21, and handle 21 and inner cover 60 are concurrently arranged about axis X of handle 21. According to the invention, end gap 70 severing inner cover 60 from first end 61 to second end 62 enables inner cover to automatically flexibly circumferentially adjust to handles having slightly varying outer diameters when inner cover 60 is installed over the handle as described above, end gap 70 between first and second marginal extremities 71 and 72 widening and narrowing depending on the diameter of the given handle. Having installed inner cover 60 onto length L of handle 21 between inner end 22 and outer end 23, outer cover 80 is installed over inner cover 60 to form handle assembly 40 in FIGS. 1, 12, and 13.

Figure 10:
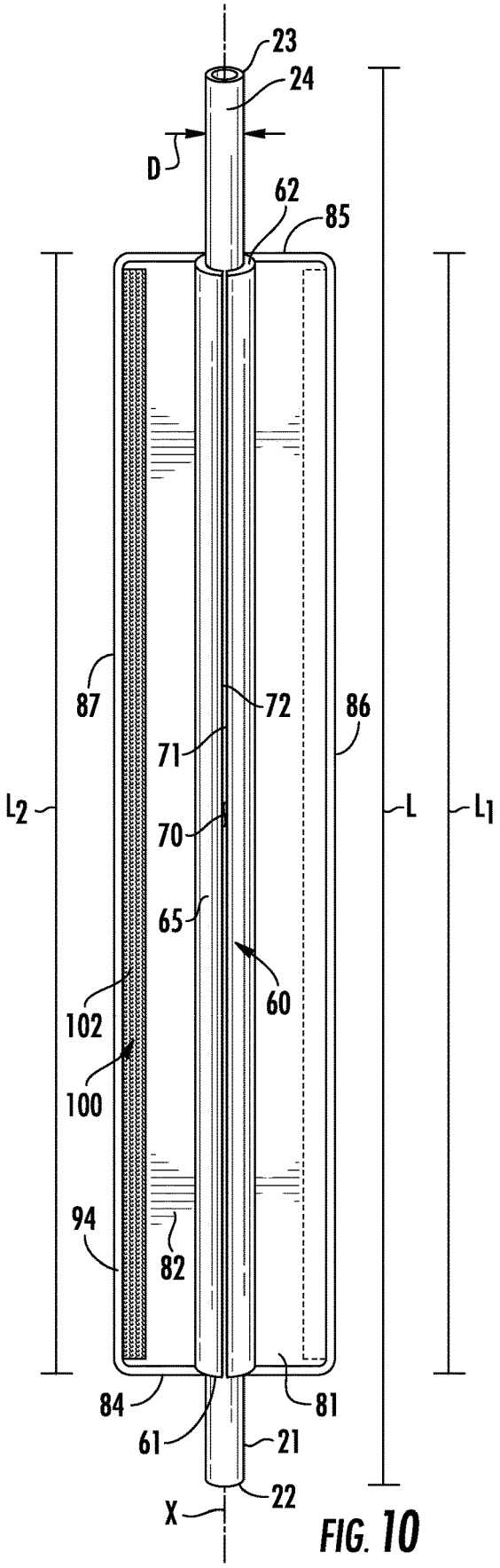
FIGS. 10-12 illustrate a sequence of steps of installing the outer cover of FIGS. 5 and 6 on the inner cover installed on the handle shown in FIG. 9.
Figure 11:
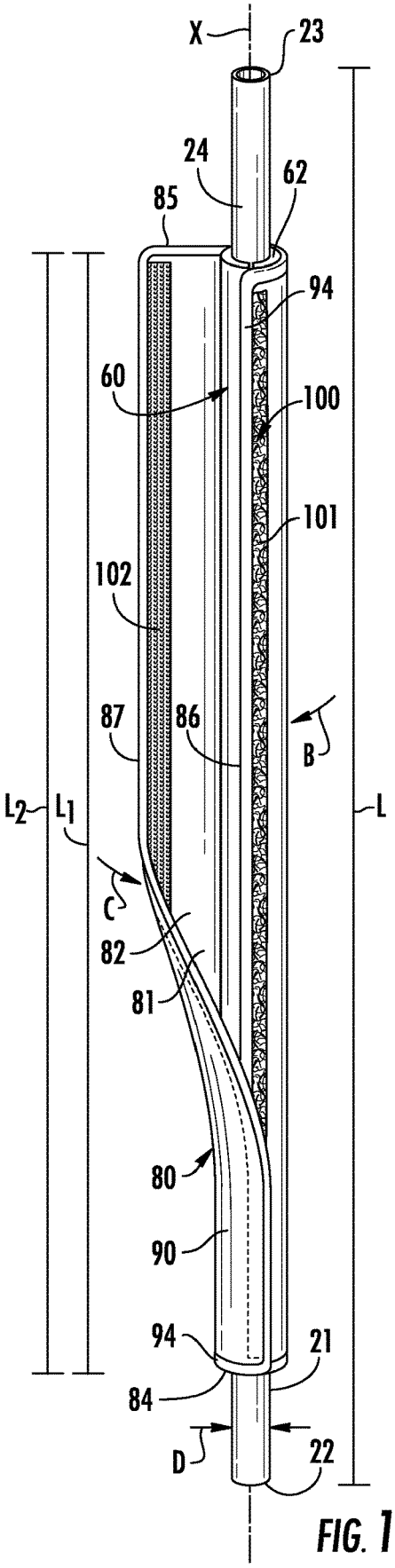

To install outer cover 80 over inner cover 60 according to the installation method, in FIG. 10, length L2 of outer cover 80 from first end 84 to second end 85 is aligned with length L1 of inner cover 60 from first end 61 to second end 62, and inner surface 82 of outer cover 80 between first marginal extremity 86 and second marginal extremity 87 along length L2 of outer cover 80 from first end 84 of outer cover 80 to second end 85 of outer cover 80 is positioned against outer surface 65 of inner cover 60 while at the same time juxtaposing first ends 84 and 61 of the respective outer and inner covers 80 and 60 and second ends 85 and 62 of the respective outer and inner covers 80 and 60. From the orientation in FIG. 10, in FIG. 11 first marginal extremity 86 from first end 84 to second end 85 of outer cover 80 is wrapped over outer surface 65 of inner cover 60 in the direction of arrowed line B, and second marginal extremity 87 is subsequently wrapped tightly in the opposite direction indicated by arrowed line B toward first marginal extremity 86 over outer surface 65 of inner cover 60 juxtaposing second marginal extremity 87 with first marginal extremity 86 by overlapping inner surface 82 of substrate 81 of second marginal extremity 87 over gripping surface 90 of first marginal extremity 86 while at the same time registering and bringing into direct contact the length of complemental element 102 of fastener 100 along length L2 of outer cover 80 between first end 84 of outer cover 80 and second end 85 of outer cover 80 to the length of element 101 of fastener 100 along length L1 of outer cover 80 between first end 84 of outer cover 80 and second end 85 of outer cover 80 releasably securing the length of complemental element 102 of fastener 100 between first end 84 and second end 85 of outer cover 80 to the length of element 101 of fastener 100 between first end 84 of outer cover 80 and second end 85 of outer cover 80 in reference to FIGS. 12 and 13 releasably securing first marginal extremity 86 to second marginal extremity 87 releasably securing outer cover 80 wrapped over inner cover 60 forming handle assembly 40. Length L2 of outer cover 80 is equal to length L1 of inner cover 60. Width W of outer cover 80 is sufficient to enable second marginal extremity 87 to overlap first marginal extremity 86 and register and engage element 101 of fastener 100 to complemental element 102 of fastener 100 for releasably securing second marginal extremity 87 to first marginal extremity 86 when outer cover 80 is wrapped over inner cover 60. In the resulting installation of outer cover 80, outer cover 80 is wrapped about, and encircles or otherwise girdles, inner cover 60. According to the invention, width W of outer cover 80 enables outer cover 80 to automatically flexibly circumferentially adjust to inner cover 60 applied to handles having slightly varying outer diameters when outer cover 80 is installed over inner cover 60, the overlap between second marginal extremity 87 and first marginal extremity 86 decreasing and increasing narrowing depending on the diameter of the given handle over which inner cover 60 is installed.

Figure 12:
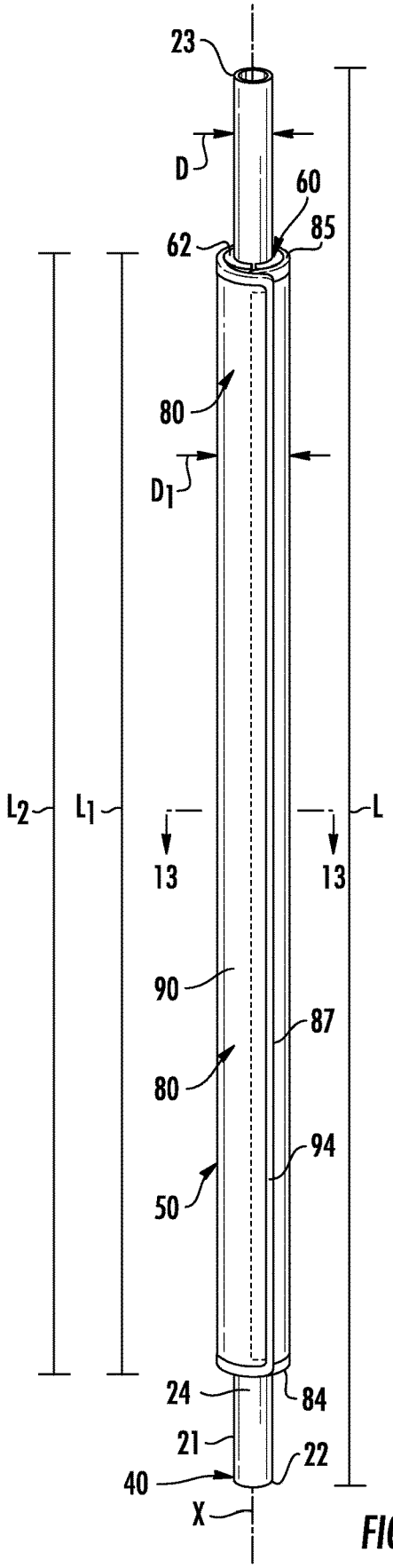
Figure 13:
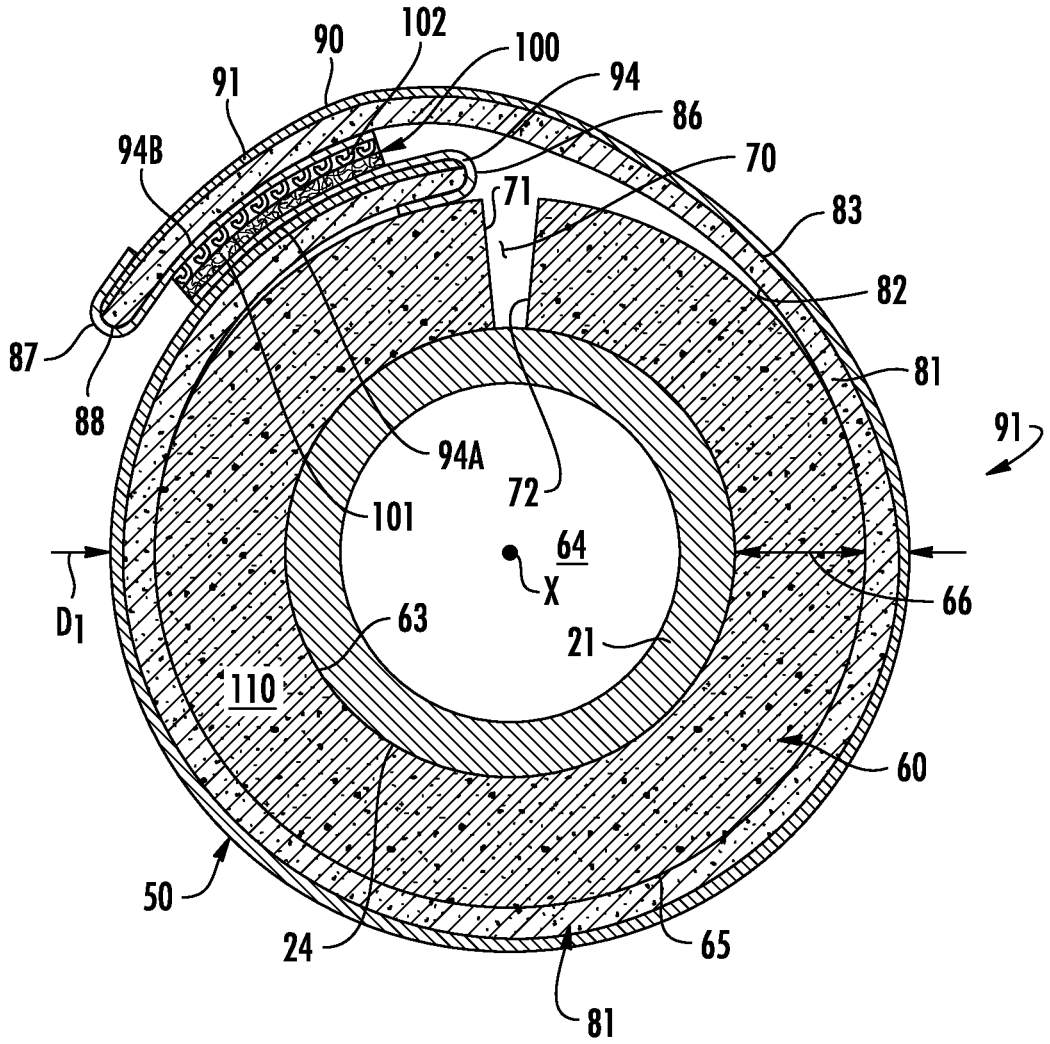
FIG. 13 is a section view taken along line 13-13 of FIG. 12.
Figure 14:
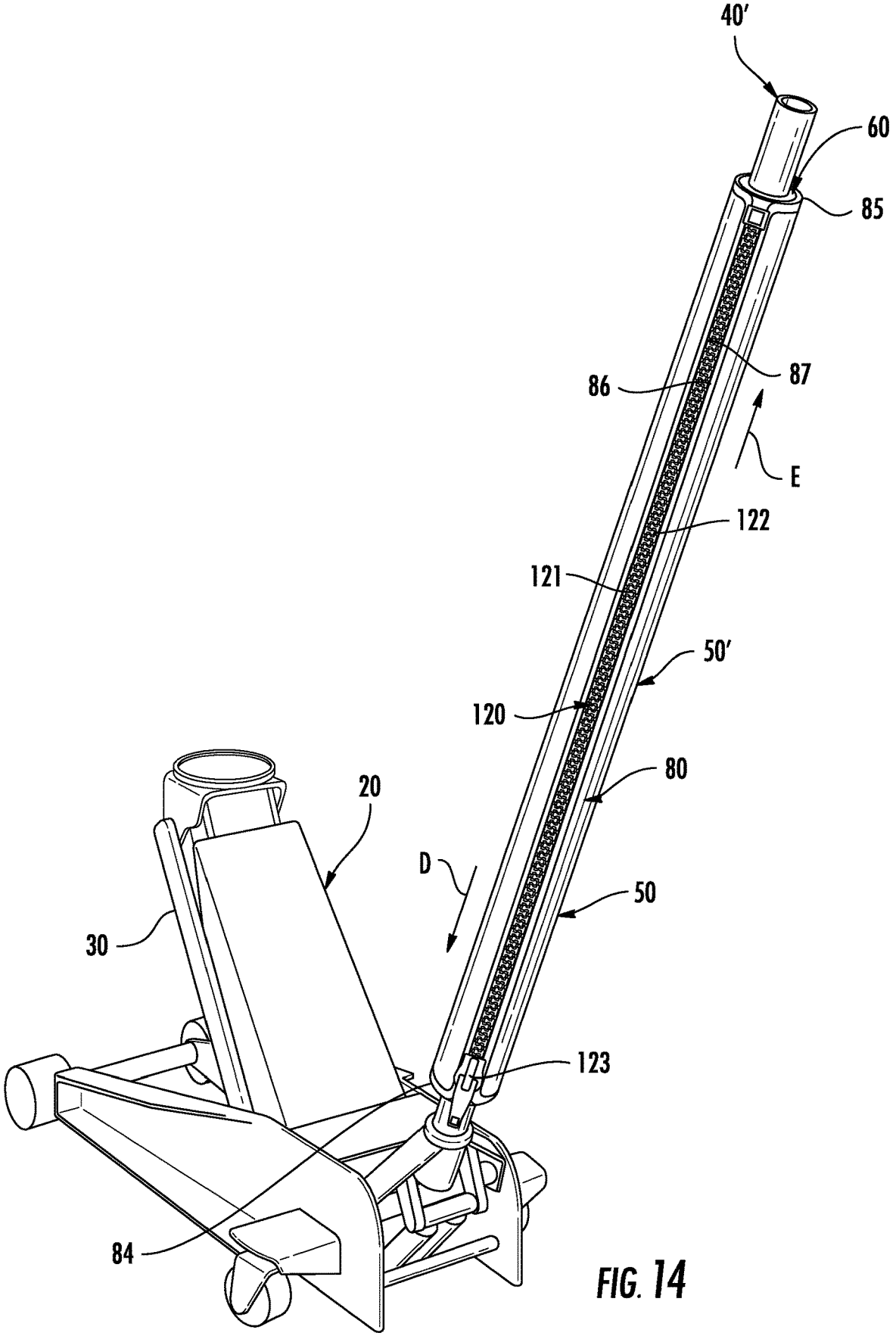
FIG. 14 is a perspective view of the handle-operated machine of FIG. 1 illustrating an alternate embodiment of a handle assembly constructed and arranged in accordance with the principle of the invention.

In handle assembly 40 in reference to FIGS. 1, 12 and 13, length L of handle 21 between inner end 22 and outer end 23 extends through volume 64 from first end 61 of inner cover 60 to second end 62 of inner cover 60, inner cover 60 circumscribes, encircles, girdles, or otherwise extends around diameter D and outer surface 24 of length L of handle 21 between inner and outer ends 22 and 23 of handle 21 from first marginal extremity 71 of inner cover 60 to second marginal extremity 72 of inner cover 60 and from first end 61 of inner cover to second end 62 of inner cover 60, the inherent shape memory material characteristic of inner cover 60 causes inner cover 60 to circumferentially constrict inner surface 63 of inner cover 60 directly against outer surface 24 of length L of handle 21 between inner end 22 and outer end 23 of handle 21 from first marginal extremity 71 to second marginal extremity 72 of inner cover 60 and from first end 61 to second end 62 of inner cover 60, thickness 66 of inner cover 60 extends outwardly from inner surface 64 to outer surface 65 which extends from first end 61 to second end 62 and from first marginal extremity 71 to second marginal extremity 72, length L1 of inner cover 60 from first end 61 to second end 62 extends along length L of handle 21 between inner and outer ends 22 and 23 of handle 21, inner surface 82 of outer cover 80 defines volume 110 (FIG. 13) from first end 84 to second end 85 of outer cover 80, first ends 61 and 84 of the respective inner and outer covers 60 and 80 are juxtaposed proximate to first end 22 of handle 21, second ends 62 and 85 of the respective inner and outer covers 60 and 80 are juxtaposed proximate to outer end 23 of handle 21, length L1 of inner cover 60 extends through volume 110 from first end 84 of outer cover 80 to second end 85 of outer cover 80, the wrapping of outer cover 80 around inner cover 60 circumferentially constricts inner surface 82 of substrate 81 of outer cover 80 between first and second marginal extremities 86 and 87 and along length L2 of outer cover 80 from first end of outer cover 80 to second end 85 of outer cover 80 against outer surface 65 of inner cover 60 along length L1 of inner cover 60 from first end 61 of inner cover 60 to second end 62 of inner cover 60, inner cover 60 and outer cover 80 concurrently circumscribe or otherwise extend around outer surface 24 of length L of handle 21 between inner end 22 of handle 21 and outer end 23 of handle 21, substrate 81 extends outwardly from inner surface 82 in frictional contact against and thereby frictionally gripping outer surface 65 of inner cover 60 to gripping surface 90 of layer 91 on outer surface 83 of substrate 81, gripping surface 90 of outer cover 80 extends from first end 84 to second end 85 and from first marginal extremity 86 to second marginal extremity 87 and is exposed exteriorly for being gripped by hand, inner end 22 of handle 21 extends beyond first ends 61 and 84 of the respective inner and outer covers 60 and 80 to enable inner end 22 to be operatively connected to a handle operated machine, such as to receiver 31 of jack 20, without interference from both inner cover 60 and outer cover 80 of multipart cover 50, outer end 23 of handle 21 extends beyond second ends 62 and 85 of the respective inner and outer covers 60 and 80, and handle 21, inner cover 60, and outer cover 80 are concurrently arranged about axis X of handle 21, all according to the invention. Gripping surface 90 of handle assembly 40 defines diameter D1 from first ends 61 and 84 of the respective inner and outer covers 60 and 80 to second ends 72 and 85 of the respective inner and outer covers 60 and 80, which is larger than diameter D of handle 21. To dissemble handle assembly 40, the foregoing operation for assembling handle assembly 40 need only be reversed.

Handle assembly 40 is useful with machine 20 in FIG. 1 operable for performing a task in response to manual actuation of handle assembly 40. As explained above, machine 20 is a well-known floor jack 30 operated by handle assembly 40 when handle assembly 40 is operatively connected to jack 30. In FIG. 1, inner end 22 of handle 21 of handle assembly 40 is conventionally secured to the known receiver 31 of jack 30 operatively coupling handle 21 of handle assembly 40 to jack 30, which is operable for lifting and lowering heavy loads and applying great forces in response to cranking handle assembly 40 back-and-forth by hand in the directions indicated by double arrowed line A. Again, jack 30 is an example of a handle-operated machine, a machine operated by a manual actuation of handle assembly 40, operable for performing a task, the lifting and lowering of heavy loads and applying of great forces in this example, in response to manual actuation of handle assembly 40 by hand, the manual cranking of handle assembly 40 by hand back-and-forth in the direction of double arrowed line A in this example.

To use handle assembly 40, the skilled workman grips gripping surface 90 at a chosen location between first and second ends 84 and 85 of outer cover 80 and then proceeds to actuate handle assembly 40 by cranking it back and forth in the directions indicated by double arrowed line A in FIG. 1. Since gripping surface 90 is chemically resistant, chemically-resistant gripping surface 90 is chemically resistant and impervious to lubricants, greases, motor oils, fuels, solvents, and other chemical substances, for isolating handle 21 from these and like or similar chemical substances commonly found in workshops and garages for cleaning, maintaining, repairing, and operating machines, equipment, motors, vehicles, etc., keeping handle 21 covered by multipart cover 50 free from these and other substances and free from the corrosive effects of these and other substances. The chemical resistance of gripping surface 90 is resistant to slipping even when chemical substances are on the workman's hands. Accordingly, gripping surface 90 resists the workman's hands from slipping thereon when the workman's hands are coated with chemical substances, and at the same time isolates the length L of handle 21 between inner and outer ends 22 and 23 of handle 21 covered by multipart cover 50 from chemical substances on the workman's hands, according to the invention. Furthermore, the larger diameter D1 of multipart cover 50 and the inherent cushiony, compressible, flexible, and resilient material characteristics of inner cover 60 and outer cover 80 of multipart cover 50 inherently provide a larger diameter D1 gripping surface for the workman's hands compared to the comparatively smaller diameter D of handle 21 and inherently cushion the workman's hands from vibrations imparted to handle 21 during manual actuation of handle 21, all of which are favorable to safely and efficiently employing handle assembly 40 to operate jack 30 compared to actuating handle 21 without multipart cover 50, in accordance with the invention. Handle assembly 40 is useful with other types of machines commonly used in workshops or garages like machine 20, such as pumps, lifts, cranks, etc.

As explained above, fastener 100 is a hook-and-loop fastener including element 101 and complemental element 102. This hook-and-loop fastener is releasable, repeatedly useful, efficient, and easy to use. Other suitable releasable fasteners for repeatedly releasably securing and releasing first marginal extremity 86 of outer cover to and from second marginal extremity 87 of outer cover 80 can be used if desired. As a matter of example of an alternate fastener useful with outer cover 80, FIG. 13 illustrates the previously described machine 20, i.e. jack 30, handle 21, and an alternate embodiment of a multipart cover denoted at 50' forming an alternate embodiment of a handle assembly denoted at 40'. In common with multipart cover 50, multipart cover 50' shares inner cover 60, and outer cover 80, and the installation of inner cover 60 on handle 21 and outer cover 80 on inner cover is the same as described above, except for an alternate embodiment of fastener 120 useful for releasably securing first marginal extremity 86 to second marginal extremity 87 when they are juxtaposed when outer cover 80 is wrapped around inner cover 60.

In FIG. 13, fastener 120 is a slide fastener assembly including complementing rows 121 and 122 of metal or plastic teeth, and slider 123. Row 121 of teeth may be referred to as an element or engagement element of fastener 120, and row 122 of teeth may be referred to as a complementing element or complementing engagement element of fastener 120. Row 121 of teeth is secured to first marginal extremity 86 along length L2 of outer cover 80 from first end 84 to second end 85, and row 122 of teeth is secured to second marginal extremity 87 along length L2 of outer cover 80 from first end 84 to second end 85. First and second marginal extremities 86 and 87 are juxtaposed juxtaposing row 121 of teeth and row 122 of teeth when outer cover 80 is wrapped around inner cover 60 in FIG. 13. Slider 123, operated by hand, concurrently engages and meshing secures row 121 of teeth to row 122 of teeth when slider 123 moves along rows 121 and 122 of teeth in the direction of arrowed line D in a direction in this example from second ends 62 and 85 of the respective inner and outer covers 60 and 80 of multipart cover 50' to first ends 61 and 84 of the respective inner and outer covers 60 and 80 of multipart cover 50' to releasably secure first marginal extremity 86 to second marginal extremity 87 in the installation of multipart cover 50' to handle 21, and unmeshes and separates row 121 of teeth from row 122 of teeth for releasing first marginal extremity 86 from second marginal extremity 87 when slider 123 moves along rows 121 and 122 of teeth in the opposite direction of arrowed line E toward second ends 62 and 85 of the respective inner and outer covers 60 and 80 of multipart cover 50' from first ends 61 and 84 of the respective inner and outer covers 60 and 80 of multipart cover 50'. Rows 121 and 122 of teeth are affixed the respective first and second marginal extremities 86 and 87 of outer cover 80 with stitching or heat bonding or adhesive or the like. Accordingly, slider 123 meshes rows 121 and 123 of teeth together when moved in the direction indicated by the arrowed line D in FIG. 13, and separates rows 121 and 122 of teeth when moved in the direction indicated by the arrowed line E in FIG. 13. Although slider 123 meshes rows 121 and 123 of teeth to secure them together when moved in the direction indicated by the arrowed line D in FIG. 13, and separates rows 121 and 122 of teeth releasing them when moved in the direction indicated by the arrowed line E in FIG. 13, these directions can be reversed if desired. Snap fasteners, button fasteners, and other forms of releasable fasteners can be used with outer cover 80 for selectively securing and releasing first marginal extremity 86 to and from second marginal extremity 87 without departing from the invention.

Those having an exemplary handle assembly 40 is disclosed, which includes multipart cover 50 that easy to install onto handle 21 to form an exemplary handle assembly 40, which is easy to remove from handle 21, and which provides a secure gripping surface for the skilled worker to safely and efficiently grip by hand for actuating handle 21 to operate the handle-operated machine, and that is chemically-resistant for isolating handle 21 from lubricants, greases, motor oils, fuels, solvents, and other chemical substances, and from the corrosive effects thereof. According to the principle of the invention, handle assembly 40 includes elongate handle 21 including inner end 22, outer end 23, and length L between inner end 22 and outer end 23, and multipart cover 50 including inner cover 60, and outer cover 80. Inner cover 60 is fitted removably over length L of handle 21 between inner end 22 of handle 21 and outer end 23 of handle 21, and outer cover 80 is fitted removably over inner cover 60. Inner cover 60 and outer cover 80 concurrently encircle and extend along outer surface 24 and outer diameter D of length of handle 21 from proximate to inner end 22 of handle 21 to proximate to outer end 23 of handle 21, and outer cover 80 includes a chemically-resistant exterior gripping surface 90. Inner cover 60 includes first end 61 proximate to inner end 22 of handle 21, second end 62 proximate to outer end 23 of handle 21, length L1 from first end 61 of inner cover 60 to second end 62 of inner cover 60, and end gap 70 that severs inner cover 60 from first end 61 of inner cover 60 to second end 62 of inner cover 60 defining first marginal extremity 71 of inner cover 60 and second marginal extremity 72 of inner cover 60 concurrently extending from first end 61 of inner cover 60 to second end 62 of inner cover 60. Inner cover 60 is fabricated of a cushiony, compressible material, which is foam in an illustrative embodiment as described herein. Outer cover 80 includes first end 84 proximate to first end 61 of inner cover 60, second end 85 proximate to second end 62 of inner cover 60, length L2 from first end 84 of outer cover 80 to second end 85 of outer cover 80, inner surface 82 against inner cover 60, and outer surface 83 formed with a layer or coating 91 of a chemically-resistant material defining chemically-resistant exterior gripping surface 90 of outer cover 80. Inner end 22 of handle 21 extends beyond first end 61 of inner cover 60 and first end 84 of outer cover 80 to enable inner end 22 of handle 21 to be operatively connected to a handle operated machine, such as to receiver 31 of jack 20, without interference from both inner cover 60 and outer cover 80 of multipart cover 50, and outer end 23 of handle 21 extends beyond second end 62 of inner cover 60 and second end 85 of outer cover 80 of outer cover 80. Outer cover 80 is fabricated principally of a cushiony, compressible material, which is neoprene in an illustrative embodiment. The chemically-resistant material is a chemically-resistant elastomer as described herein. Outer cover 80 further includes first marginal extremity 86 and second marginal extremity 87 concurrently extending from first end 84 of outer cover 80 to second end 85 of outer cover 80. Substrate 81 of outer cover 80 is wrapped about inner cover 60 juxtaposing first marginal extremity 86 of outer cover 80 relative to second marginal extremity 87 of outer cover 80. A fastener 100 releasably secures first marginal extremity 86 of outer cover 80 to second marginal extremity 87 of outer cover 80. The chemically-resistant material, coating or layer 91, extends from first end 84 of outer cover 80 to second end 85 of outer cover 80 and from first marginal extremity 86 of outer cover 80 to second marginal extremity 87 of outer cover 80. Fastener 100, which is an assembly, includes a hook-and-loop fastener including element 101 thereof carried by first marginal extremity 86 of outer cover 80 and complemental element 102 thereof carried by second marginal extremity 87 of substrate 100. Element 101 is a loop medium of the hook-and-loop fastener, complemental element 102 is a hook medium of the hook-and-loop fastener, and the positioning of element 101 and complemental element 102 can be reversed without departing from the invention. In an alternate of a multipart cover denoted at 50', fastener 100 is replaced with fastener 120, which is a slide fastener assembly including complementing rows 121 and 122 of metal or plastic teeth, and slider 123, in which row 121 of teeth is carried by first marginal extremity 86, and row 122 of teeth is carried by second marginal extremity 87, and slider 123 is used to secure and release rows 121 and 122 of teeth depending on the direction of movement of slider 123 along rows 121 and 122 of teeth. As explained herein, snap fasteners, button fasteners, and other forms of releasable fasteners can be used with outer cover 80 for selectively securing and releasing first marginal extremity 86 to and from second marginal extremity 87 without departing from the invention.

The present invention is described above with reference to illustrative embodiments. However, those skilled in the art will recognize that changes and modifications may be made in the described embodiments without departing from the nature and scope of the present invention. Various further changes and modifications to the embodiments herein chosen for purposes of illustration will readily occur to those skilled in the art. To the extent that such modifications and variations do not depart from the spirit of the invention, they are intended to be included within the scope thereof.

Having fully described the invention in such clear and concise terms as to enable those skilled in the art to understand and practice the same, the invention claimed is:

1. A handle assembly, comprising:

an elongate handle including an inner end, an outer end and a length between the inner end and the outer end;

a multipart cover comprising an inner cover fitted removably over the length of the handle and an outer cover fitted removably over the inner cover, the inner cover and the outer cover concurrently encircle and extend along the length of the handle from proximate to the inner end of the handle to proximate to the outer end of the handle;

the inner cover includes a first end proximate to the inner end of the handle and a second end proximate to the outer end of the handle;

the outer cover includes a first end proximate to the first end of the inner cover and a second end proximate to the second end of the inner cover;

the inner end of the handle extends beyond the first end of the inner cover and the first end of the outer cover;

the outer end of the handle extends beyond the second end of the inner cover and the second end of the outer cover; and the outer cover includes an exterior gripping surface comprising a chemically-resistant material.

2. The handle assembly according to claim 1, wherein the inner cover is fabricated of a compressible material.

3. The handle assembly according to claim 1, wherein the outer cover is fabricated of a compressible material.

4. The handle assembly according to claim 1, wherein the chemically-resistant material comprises a chemically-resistant elastomer.

5. The handle assembly according to claim 1, wherein the chemically-resistant material extends from the first end of the outer cover to the second end of the outer cover.

6. A handle assembly, comprising:

an elongate handle including an inner end, an outer end and a length between the inner end and the outer end;

a multipart cover comprising an inner cover fitted removably over the length of the handle and an outer cover fitted removably over the inner cover, the inner cover and the outer cover concurrently encircle and extend along the length of the handle from proximate to the inner end of the handle to proximate to the outer end of the handle;

the outer cover includes a first marginal extremity and a second marginal extremity extending between the first end of the outer cover to the second end of the outer cover;

the outer cover is wrapped about the inner cover juxtaposing the first marginal extremity relative to the second marginal extremity;

a fastener releasably securing the first marginal extremity of the outer cover to the second marginal extremity of the outer cover; and the outer cover includes an exterior gripping surface comprising a chemically-resistant material.

7. The handle assembly according to claim 6, wherein:

the inner cover includes a first end proximate to the inner end of the handle and a second end proximate to the outer end of the handle;

the outer cover includes a first end proximate to the first end of the inner cover and a second end proximate to the second end of the inner cover;

the inner end of the handle extends beyond the first end of the inner cover and the first end of the outer cover; and the outer end of the handle extends beyond the second end of the inner cover and the second end of the outer cover.

8. The handle assembly according to claim 6, wherein the fastener comprises a hook-and-loop fastener including an element thereof carried by the first marginal extremity of the outer cover and a complemental element thereof carried by the second marginal extremity of the outer cover.

9. The handle assembly according to claim 6, wherein the fastener comprises a slide fastener.

10. The handle assembly according to claim 6, wherein the inner cover is fabricated of a compressible material.

11. The handle assembly according to claim 6, wherein the outer cover is fabricated of a compressible material.

12. The handle assembly according to claim 6, wherein the chemically-resistant material comprises a chemically-resistant elastomer.

13. The handle assembly according to claim 6, wherein the chemically-resistant material extends from the first marginal extremity to the second marginal extremity.

* * * * *